US007838079B2

(12) United States Patent
Chu et al.

(10) Patent No.: US 7,838,079 B2
(45) Date of Patent: Nov. 23, 2010

(54) COATED ARMOR SYSTEM AND PROCESS FOR MAKING THE SAME

(75) Inventors: Henry S. Chu, Idaho Falls, ID (US); Thomas M. Lillo, Idaho Falls, ID (US); Kevin M. McHugh, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 1133 days.

(21) Appl. No.: 10/992,521

(22) Filed: Nov. 17, 2004

(65) Prior Publication Data

US 2006/0105183 A1 May 18, 2006

(51) Int. Cl.
*B05D 3/12* (2006.01)

(52) U.S. Cl. ..... 427/421.1; 427/248.1; 427/369; 427/372.2; 427/402; 428/469

(58) Field of Classification Search ..... 427/421.1
See application file for complete search history.

(56) References Cited

U.S. PATENT DOCUMENTS 4,232,056 A * 11/1980 Grant et al. ..... 427/449
4,704,943 A * 11/1987 McDougal ..... 89/36.02
5,196,240 A 3/1993 Stockwell
5,235,895 A * 8/1993 Vanark et al. ..... 89/36.02
5,401,539 A * 3/1995 Coombs et al. ..... 427/422
5,445,324 A 8/1995 Berry et al.
5,483,864 A 1/1996 Vanark et al.
5,718,863 A 2/1998 McHugh et al.
6,074,194 A * 6/2000 McHugh ..... 425/447
6,224,943 B1 5/2001 Knepper et al.
6,271,162 B1 * 8/2001 Haug et al. ..... 501/87
6,656,570 B1 12/2003 Fels et al.
6,679,157 B2 * 1/2004 Bruck et al. ..... 89/36.02
6,746,225 B1 * 6/2004 McHugh ..... 425/130
2002/0058107 A1 5/2002 Fareed et al.
2002/0058576 A1 5/2002 Mazany et al.
2002/0160198 A1 10/2002 Oshima et al.
2002/0178672 A1 12/2002 Robinson et al.
2002/0178900 A1 * 12/2002 Ghiorse et al. ..... 89/36.02
2003/0064191 A1 4/2003 Fisher
2004/0115477 A1 6/2004 Nesbitt

OTHER PUBLICATIONS

International Search Report for PCT/US05/39815 mailed Aug. 20, 2007, 2 pages.

* cited by examiner

*Primary Examiner*—Timothy H Meeks
*Assistant Examiner*—Nathan T Leong
(74) *Attorney, Agent, or Firm*—TraskBritt

(57) ABSTRACT

An armor system and method involves providing a core material and a stream of atomized coating material that comprises a liquid fraction and a solid fraction. An initial layer is deposited on the core material by positioning the core material in the stream of atomized coating material wherein the solid fraction of the stream of atomized coating material is less than the liquid fraction of the stream of atomized coating material on a weight basis. An outer layer is then deposited on the initial layer by positioning the core material in the stream of atomized coating material wherein the solid fraction of the stream of atomized coating material is greater than the liquid fraction of the stream of atomized coating material on a weight basis.

27 Claims, 6 Drawing Sheets

COATED ARMOR SYSTEM AND PROCESS FOR MAKING THE SAME

CONTRACTUAL ORIGIN OF THE INVENTION

This invention was made with government support under Contract Numbers DE-AC07-99ID13727 and DE-AC07-05ID14517 awarded by the United States Department of Energy. The United States Government has certain rights in the invention.

TECHNICAL FIELD

This invention relates to armor systems in general and more specifically to coated armor systems.

BACKGROUND

Armor systems are known in the art and are currently being used in a wide range of applications, including, for example, aircraft, armored vehicles, and body armor systems, wherein it is desirable to provide protection against bullets and other projectiles. While early armor systems tended to rely on a single layer of a hard and brittle material, such as a ceramic material, it was soon recognized that the effectiveness of the armor system could be improved considerably if the ceramic material were affixed to or backed up with an energy-absorbing material, such as fiberglass. The presence of the energy-absorbing backup layer tends to reduce the spallation caused by impact of the projectile with the ceramic material or "impact layer" of the armor system, thereby reducing the damage caused by the projectile impact. Testing has demonstrated that such multi-layer armor systems tend to stop projectiles at higher velocities than do the ceramic materials when utilized without the backup layer.

While such multi-layer armoring systems are being used with some degree of success, they are not without their problems. For example, difficulties are often encountered in creating a structure capable of withstanding multiple projectile impacts. Another problem relates to the overall performance (e.g., energy absorbing/deflecting capability) of the armor system, and improvements in performance are always desirable.

Partly in an effort to solve the foregoing problems, armor systems have been proposed wherein the ceramic material is coated or encapsulated with a metal. The encapsulating metal coating would, at least in theory, provide some degree of structural confinement to the ceramic core material, thereby improving the ability of the ceramic core material to withstand multiple impacts. A number of manufacturing methods have been developed to fabricate metal-encapsulated ceramic armor systems, including processes that involve welding, machining, pressing, powder metallurgy, and casting. Unfortunately, however, the methods developed to date are not without their problems relating to technical feasibility, manufacturing, or economics. Consequently, the concept of an encapsulated armor system is likely to be abandoned unless a method can be developed that is feasible from both technical and economic standpoints.

SUMMARY OF THE INVENTION

A method for producing an armor system comprises providing a core material and a stream of atomized coating material that comprises a liquid fraction and a solid fraction. An initial layer is deposited on the core material by positioning the core material in the stream of atomized coating material wherein the solid fraction of the stream of atomized coating material is less than the liquid fraction of the stream of atomized coating material on a weight basis. An outer layer is then deposited on the initial layer by positioning the core material in the stream of atomized coating material wherein the solid fraction of the stream of atomized coating material is greater than the liquid fraction of the stream of atomized coating material on a weight basis.

Another method for producing an armor system comprises providing a core material and a stream of atomized coating material that comprises a liquid fraction and a solid fraction. Substantially the entirety of the core material is encapsulated with a coating layer by positioning the core material in the stream of atomized coating material. The coating layer is then compressed to form the armor system.

Armor systems according to the present invention include armor systems produced in accordance with the foregoing methods. An armor system may also comprise a core material and a coating substantially encapsulating the core material, the coating being formed by directing an atomized stream of coating material toward the core material.

BRIEF DESCRIPTION OF THE DRAWINGS

Illustrative and presently preferred embodiments of the invention are shown in the accompanying drawings in which.

DETAILED DESCRIPTION OF THE PREFERRED EMBODIMENTS

Figure 1:
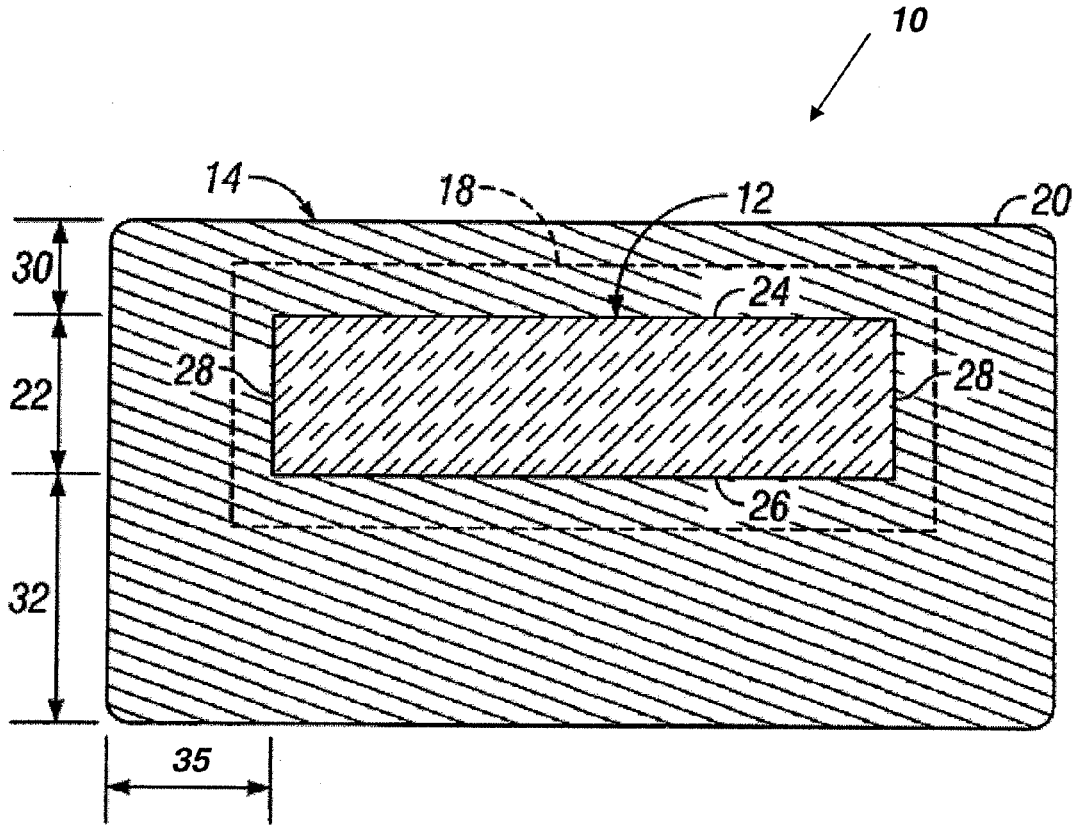
FIG. 1 is a side view in elevation of an armor system according to one embodiment of the invention.

An armor system 10 according to one embodiment of the present invention is illustrated in FIG. 1 and comprises a core material 12 having a coating 14 deposited thereon that encapsulates substantially the entirety of the core material 12. The coating 14 is formed or deposited on the core material 12 by directing an atomized stream 16 (FIG. 2) of coating material 48 (FIG. 3) toward the core material 12 in accordance with the various methods described herein.

Figure 2:
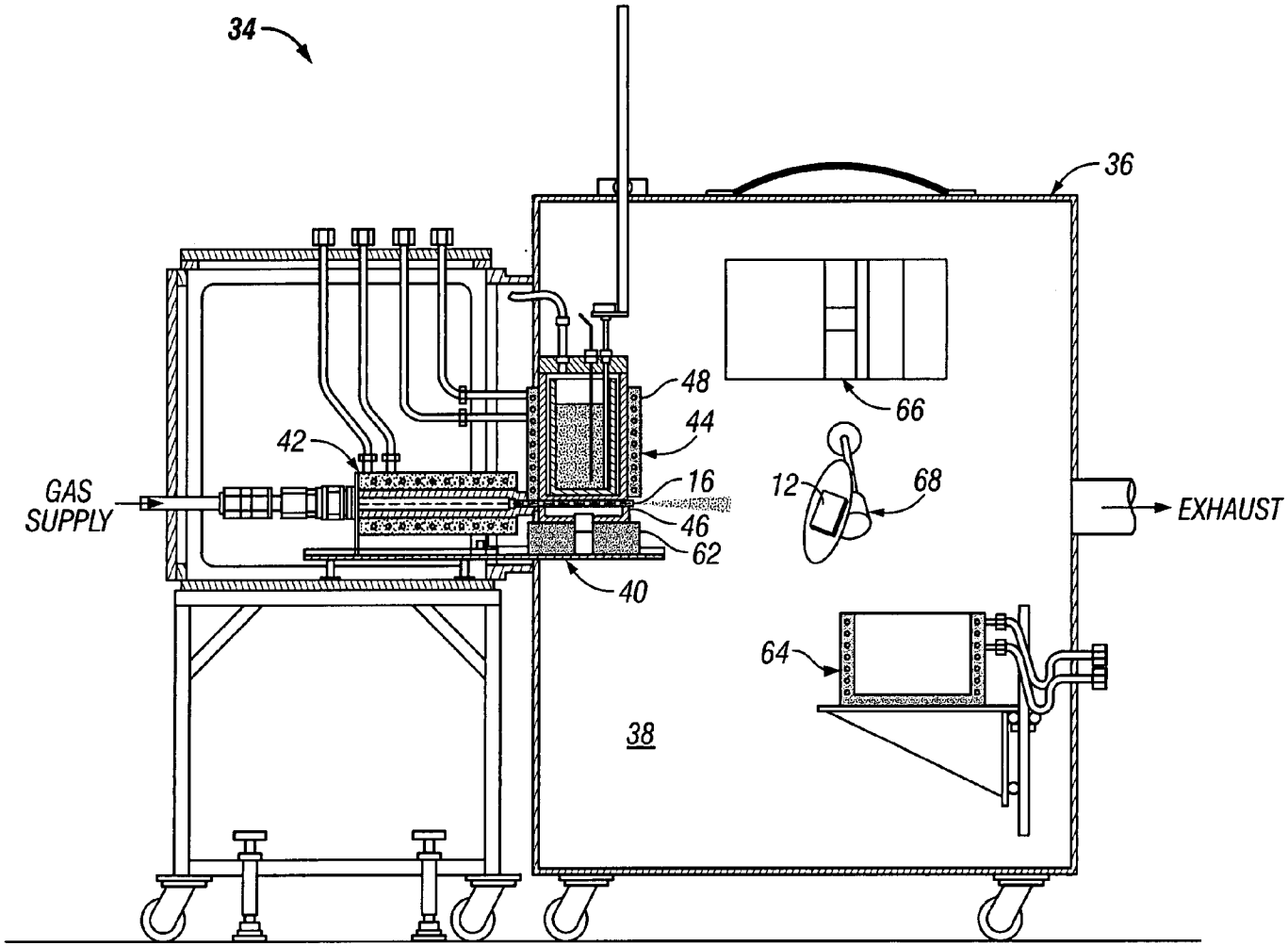
FIG. 2 is a side view in elevation of one embodiment of spray forming apparatus that may be used to produce the armor system illustrated in FIG. 1.

For example, and with reference now to FIGS. 1 and 2, in one method for producing the armor system 10, the atomized stream 16 (FIG. 2) of coating material 48 comprises a liquid or molten fraction and a solid or frozen fraction. An initial layer 18 (FIG. 1) is deposited on the core material 12 by positioning the core material 12 in the stream 16 of atomized coating material 48. The deposition of the initial layer 18 is performed at a point in the stream 16 wherein the solid fraction of the coating material 48 is about less than the liquid fraction (on a weight basis) of the stream 16 of atomized coating material 48. As will be described in greater detail below, so positioning the core material 12 in a portion of the atomized stream 16 comprising a higher proportion of the liquid fraction of the coating material 48 improves surface wetting and adhesion of the initial layer 18. After the initial layer 18 is deposited, an outer layer 20 is deposited on the initial layer 18 by positioning the core material 12 in the stream of atomized coating material 48 a point in the stream 16 wherein the solid fraction of the atomized coating material 48 is greater than the liquid fraction. The outer layer is applied with a relatively high solid fraction in order to reduce the compressive stresses applied to the core material 12. Thereafter, the coating 14 may be annealed or heat treated to further enhance the performance of the armor system 10 as will be described in greater detail below.

Another method for producing the armor system 10 involves encapsulating substantially the entirety of the core material 12 with the coating 14 by positioning the core material 12 in the stream 16 of atomized coating material 48. After being deposited, the coating 14 is then compressed to consolidate and increase the density of the coating 14. Thereafter, the coating 14 may be annealed or heat-treated to further enhance the performance of the armor system 10, as will be described in greater detail below.

A significant feature of the present invention is that it provides a means for quickly depositing an adherent coating on a core material in order to produce an encapsulated armor system. Any of a wide range of coating materials may be deposited, including pure metals, metal alloys, metal matrix compositions, and polymer compositions, thereby allowing for the production of armor systems having a wide range of performance envelopes and characteristics. The coatings produced by the processes described herein will often have improved material properties (e.g., in terms of strength and toughness) compared with cast or welded coatings. Control of the solid fraction of the layers during deposition is desirable to reduce the compressive forces applied to the core material which may damage the core material. In addition, the present invention can be used to provide coatings on core materials having complex shapes and geometries, thereby allowing the armor system to be optimized for the particular application. For example, conformal armor systems can be readily produced in accordance with the teachings of the present invention. Armor systems can also be produced having different performance capabilities at different locations. In addition, armor systems of the present invention will also have the ability to resist multiple hits.

Having briefly described the armor system 10, the various methods for making the armor system 10, as well as some of their more significant features and advantages, the various embodiments of the system and methods for making the armor system 10 will now be described in detail. However, before proceeding with the description, it should be noted that the teachings and methods described herein could be utilized in any of a wide range of applications wherein it is desired to encapsulate a core material with a coating in order to improve its performance, as would become apparent to persons having ordinary skill in the art after having become familiar with the teachings of the present invention. Consequently, the present invention should not be regarded as limited to the particular materials and applications shown and described herein.

With reference back now to FIG. 1, one embodiment of an armor system 10 may comprise a core material 12 having a coating 14 deposited thereon. In the embodiment illustrated in FIG. 1, the coating 14 encapsulates substantially the entirety of the core material 12. The core material 12 may comprise any of a wide range of materials suitable for absorbing and/or dissipating kinetic energy from a projectile. Exemplary core materials include, but are not limited to, ceramic materials, such as, for example, aluminum oxide ($Al_2O_3$), silicon carbide (SiC), and titanium diboride ($TiB_2$). Fiber-reinforced composite materials may also be used. Alternatively, the core material 12 could comprise a graded metal matrix composite material, such as that disclosed in U.S. Pat. No. 6,679,157, entitled "Lightweight Armor System and Process for Producing the Same," which is incorporated herein by reference for all that it discloses. By way of example, in one embodiment, the core material 12 comprises a ceramic plate or "tile" of aluminum oxide, which is available from CoorsTek, Inc., of Golden, Colo. (USA), as product type AD-90.

It should be noted that the core material 12 should not be regarded as limited to generally plate-like or tile-like form or configuration, but could instead comprise any of a wide variety of forms or configurations (e.g., plate, shell, cylindrical, or irregular), depending on the particular application. Indeed, and as mentioned above, a significant advantage of the present invention is that the spray deposition process disclosed herein may be used regardless of the particular form or configuration of the core material 12. That is, core materials 12 having curved or complex shapes may be coated just as easily as a core materials 12 having generally flat, plate-like or tile-like configurations.

The thickness 22 of the core material 12 should be selected so that the core material 12 will provide sufficient strength to allow the armor system 10 to stop projectiles having given properties and impact velocities. By way of example, in one embodiment, the core material 12 has a thickness of about 3.2 mm. Alternatively, core materials 12 having other thicknesses could be used depending on the particular application and desired performance envelope of the armor system 10. Therefore, the present invention should not be regarded as limited to core materials having any particular composition, configuration, or thickness.

The coating 14 may comprise any of a wide range of materials suitable for mechanically constraining the core material 12 to prevent the core material 12 from shattering in response to projectile impact. Thus, the coating 14 generally increases the ability of the armor system 10 to absorb multiple projectile hits. Generally speaking, it will be advantageous to form the coating 14 from a coating material 48 (FIG. 3) having a high mechanical strength as well as a high toughness. In addition, coating materials (e.g., coating material 48) that combine high mechanical strength and toughness with a low specific gravity (i.e., density) will be particularly advantageous if it is desired to produce an armor system 10 that is light in weight. Generally speaking, any of a wide range of metals and metal alloys, such as aluminum and titanium, as well as various alloys containing aluminum and titanium, will make suitable coatings 14. Various steel alloys may also be used, although they will typically result in heavier armor systems.

It is important to recognize that the coating 14 is not limited to metals or metal alloys, and other types of coating materials 48 (FIG. 3) may be used. For example, other types of coating materials 48 that may be used to form the coating 14 include metal matrix composite materials formed from a mixture of metal and ceramic materials. Such metal matrix composite materials combine metallic properties, such as high toughness, thermal shock resistance, and high thermal and electrical conductivities, with ceramic properties, such as corrosion resistance, strength, high modulus, and wear resistance. The partitioning of these properties depends on the choice and volume fraction of the ceramic and metal components comprising the metal matrix composite material. One example of a metal matrix composite material includes a mixture of aluminum and aluminum oxide, although others are known.

Still other types of coating materials 48 that may be used to form the coating 14 include polymer materials, such as polycarbonate, polypropylene, polyurethane and urea. The use of polymers for the coating material 48 used to produce the coating 14 may be advantageous in certain applications, as would become apparent to persons having ordinary skill in the art after having become familiar with the teachings provided herein.

The coating 14 may be deposited on the core material 12 in various thicknesses depending on the particular type of coating material 48, the particular core material 12, as well as on the desired performance of the armor system 10. Consequently, the present invention should not be regarded as limited to coatings 14 having any particular thicknesses. However, notwithstanding the fact that the coating 14 may comprise any of a range of thicknesses, we have found that the performance of the armor system 10 can be enhanced when the thickness of the coating 14 bears some relation to the thickness of the core material 12.

For example, in the embodiment illustrated in FIG. 1, wherein the core material 12 comprises a generally plate-like or tile-like configuration having a front surface 24, a back surface 26 and one or more side surfaces 28, we have found that the performance of the armor system 10 is generally enhanced if the thickness 30 of the coating 14 provided on the front surface 24 of the core material 12 is generally equal to or greater than about 0.5 times the thickness 22 of the core material 12. Similarly, the thickness 32 of the coating 14 provided on the back surface 26 of core material 12 may be generally equal to or greater than about 1.5 times the thickness 22 of the core material 12. The thickness 35 of the coating 14 provided on the one or more side surfaces 28 of the core material 12 may be at least generally equal to or greater than the thickness 22 of the core material 12.

The coating 14 is deposited on the core material 12 by a spray forming apparatus 34 of the type illustrated in FIG. 2 and disclosed in the following U.S. patents, each of which is specifically incorporated herein by reference for all that it discloses: U.S. Pat. No. 5,445,324, issued Aug. 29, 1995, entitled "Pressurized Feed-Injection Spray-Forming Apparatus;" U.S. Pat. No. 5,718,863, issued Feb. 17, 1998, entitled "Spray Forming Process for Producing Molds, Dies, and Related Tooling;" U.S. Pat. No. 6,074,194, issued Jun. 13, 2000, entitled "Spray Forming System for Producing Molds, Dies, and Related Tooling;" and U.S. Pat. No. 6,746,225, issued Jun. 8, 2004, entitled "Rapid Solidification Processing System for Producing Molds, Dies, and Related Tooling." The spray forming apparatus 34 will be briefly described herein in order to provide a basis for more fully understanding and appreciating aspects of the present invention. Specific details of the spray forming apparatus 34 not presented herein may be obtained by referring to the references identified above.

Figure 3:
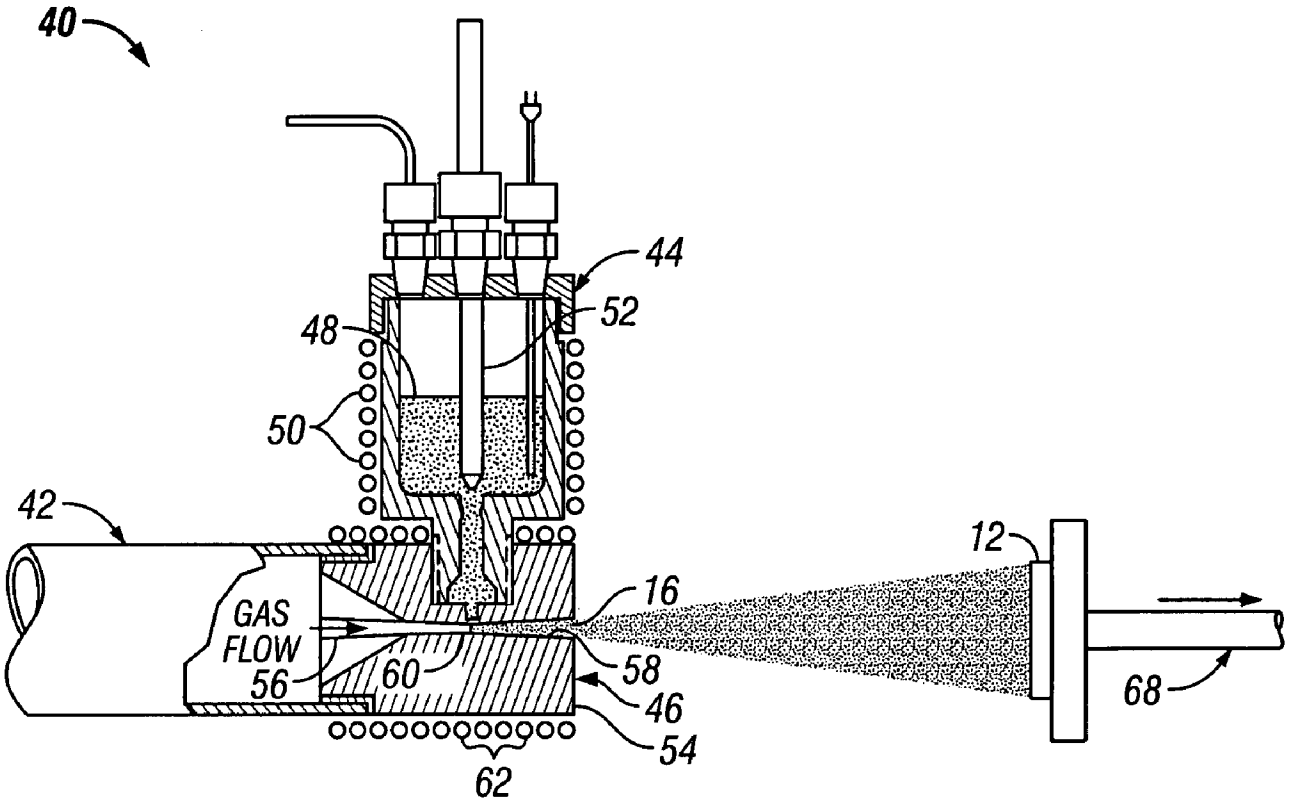
FIG. 3 is a sectional view of one embodiment of atomizer apparatus that may be used to produce a stream of atomized coating material.

Referring now to FIGS. 2 and 3 simultaneously, the spray forming apparatus 34 that may be utilized in one embodiment of the present invention comprises a process chamber 36 suitable for housing the various components of the spray forming apparatus 34 and for allowing the deposition processes to be conducted in accordance with the teachings provided herein. The process chamber 36 may be provided with suitable ancillary equipment, such as a process gas supply, a pressure regulating system, and an exhaust system (not shown), to allow a suitable process gas, such as nitrogen, to be introduced into the process chamber 36 and to allow the interior region 38 of the process chamber 36 to be maintained within a range of pressures suitable for carrying out the spray deposition process in accordance with the teachings provided herein. However, because such ancillary equipment could be easily provided by persons having ordinary skill in the art after having become familiar with the teachings provided herein, the particular ancillary equipment that may be provided to the process chamber 36 will not be described in further detail herein.

The process chamber 36 may be fabricated from any of a wide range of materials suitable for the intended application. By way of example, in one embodiment, the process chamber 36 is fabricated from stainless steel, although other materials could be used.

The atomized stream 16 of coating material 48 (FIG. 3) is produced by an atomizer assembly 40 comprising a gas feed assembly 42, a coating material feed assembly 44, and a nozzle assembly 46. The gas feed assembly 42 provides a supply of atomizing gas to the nozzle assembly 46. Generally speaking, it is preferable to use an atomizing gas (or combination of gases) that is compatible with the coating material 48 being sprayed and that will not react with the coating material 48 being sprayed or with the various components of the spray forming apparatus 34. Examples of atomizing gases include argon, nitrogen, helium, air, oxygen, and neon, as well as various combinations thereof. However, it should be noted that in some cases it may be desirable to use an atomizing gas which will react with the coating material 48 in a known way to improve or modify the properties of the coating 14. For example, atomizing with nitrogen gas low carbon steel alloyed with aluminum results in the formation of fine aluminum nitride particles that act as grain boundary pinning sites to refine the steel micro-structure of the resulting coating 14.

The temperature and pressure of the atomizing gas provided to the nozzle assembly 46 may be independently controlled by means well-known in the art. Generally speaking, the total temperature of the atomizing gas entering the nozzle assembly 46 will be in the range of about 20° C. to about 2000° C. depending on the application. However, in this regard it should be noted that the gas temperature should be sufficiently high so as to prevent the coating material 48 from freezing before it is atomized. As will be described in greater detail below, the pressure of the atomizing gas provided to the nozzle assembly 46 should be selected to provide the desired flow conditions (e.g., subsonic, sonic, or supersonic) within the nozzle assembly 46. Generally speaking, the total pressure of the atomizing gas entering the nozzle assembly 46 will be in the range of about 100 kPa to about 700 kPa for most applications.

Referring now primarily to FIG. 3, the coating material feed assembly 44 is operatively associated with the nozzle assembly 46 and provides the coating material 48 in liquid form to the nozzle assembly 46. The coating material feed assembly 44 may be pressurized if desired in order to assist in the delivery of the liquefied coating material 48 to the nozzle assembly 46. By providing a pressurized liquid coating material feed, increased atomizing gas pressure through the nozzle assembly 46 can be used and larger flow rates of liquid coating material 48 are possible. Another advantage of using a pressurized liquid feed is that it provides a greater control of the operating characteristics, such as temperature, velocity, droplet size, droplet size distribution, of the atomized stream 16. Depending on the coating material 48 to be atomized, it may be necessary or desirable to provide the coating material feed assembly 44 with a heater 50 suitable for maintaining the coating material 48 in a liquid state. The heater 50 may comprise any a wide range of heaters suitable for the particular application, as would be apparent to persons having ordinary skill in the art after having become familiar with the teachings of the present invention. By way of example, in one embodiment, the heater 50 comprises an induction heater. The coating material feed assembly 44 may also be provided with suitable flow control apparatus, such as a needle valve assembly 52, for regulating the flow of coating material 48 into the nozzle assembly 46.

The nozzle assembly 46 is operatively associated with the gas feed assembly 42 and the material feed assembly 44 and, in one embodiment, may comprise a converging/diverging nozzle 54 (e.g., a DeLaval nozzle) having a converging section 56 and a diverging section 58 separated by a throat section 60. The gas feed assembly 42 provides an atomizing gas (e.g., nitrogen) under pressure to the entrance of the converging section 56 of the nozzle 54. The atomizing gas is accelerated in the converging section 56 of the nozzle 54, whereupon it enters the throat section 60 of the nozzle 54. The atomizing gas is then ultimately discharged by the diverging section 58 of the nozzle 54. Depending on the particular pressure ratios involved (e.g., the entrance pressure and discharge pressure), the flow in the nozzle 54 may be entirely subsonic, sonic at the throat section 60 only, or sonic at the throat section 60 and supersonic in the diverging section 58 of the nozzle 54. In many applications, the atomizing gas will reach sonic speed in the throat section 60 and accelerate to supersonic speeds in at least a portion of the diverging section 58 of the nozzle 54.

Depending on the particular application, it may be desired or required to provide the nozzle assembly 46 with a heater 62 to prevent the liquid coating material 48 from freezing while still within the nozzle 54. Any of a wide range of heaters 62 may be utilized for this purpose, as would become apparent to persons having ordinary skill in the art after having become familiar with the teachings provided herein. By way of example, in one embodiment, the heater 62 comprises an induction heater.

The coating material feed assembly 44 is operatively associated with the nozzle 54 so that the coating material 48 is discharged into the throat section 60 of the nozzle 54. Alternatively, the coating material 48 may be discharged into the nozzle 54 at positions slightly upstream of or downstream from the throat section 60, as mentioned in the various patents described above and incorporated herein by reference.

Referring back now to FIG. 2, the process chamber 36 may also be provided with a core material heating system 64 suitable for pre-heating the core material 12 in accordance with the teachings provided herein. In the embodiment shown and described herein, the core material heating system 64 comprises an induction-type heater or furnace, although other types of heating devices may also be used.

Process chamber 36 may also be provided with a press system 66 suitable for pressing (i.e., compressing) the coating 14 deposited on the core material 12. In the embodiment shown and described herein, the press system comprises a uni-axial press that exerts pressure along a single dimension or axis. Alternatively, the press system 66 may comprise apparatus for performing hot iso-static pressing or cold isostatic pressing. However, because pressing systems are known in the art and could be easily provided by persons having ordinary skill in the art after having become familiar with the teachings provided herein, the particular press system 66 utilized in one embodiment will not be described in further detail herein.

The process chamber 36 is also provided with a core material holder and manipulating system 68 suitable for holding the core material 12 and for moving it to various locations throughout the process chamber 36. For example, in the embodiment shown and described herein, the manipulating system 68 is capable of moving the core material 12 between the core material heating system 64, the atomized stream 16, and the press system 66. The manipulating system 68 is also capable of moving the core material 12 within the atomized stream 16 in a way that will allow the coating material 48 to be deposited on all of the surfaces (e.g., the front, back, and side surfaces 24, 26, and 28, respectively) of the core material 12, thereby encapsulating substantially the entirety of the core material 12 with the coating 14.

Comparatively high material deposition rates are possible with the spray forming apparatus 34. For example, aluminum and aluminum alloys have been deposited at rates up to about 227 kg/hour and steel alloys up to about 545 kg/hour with the bench-scale system shown and described herein. Of course, higher rates could be easily achieved by providing larger components to the spray forming apparatus 34.

As mentioned above, the coating 14 may be deposited on the core material 12 in accordance with the various methods described herein to produce the armor system 10. However, before describing those methods, it will be helpful to discuss the atomization process that results in the atomized stream 16.

The particular flow velocity utilized in the nozzle 54 will depend on the characteristics of the particular coating material 48 provided by the coating material feed assembly 44 as well as on the degree of atomization desired. The atomizing gas in the nozzle 54 disintegrates the liquid coating material 48 and entrains the resultant atomized droplets into a highly directed, two-phase (e.g., liquid/gas) or multi-phase (e.g., liquid, gas, solid) flow. During atomization, a liquid is disintegrated into relatively fine droplets by the action of aerodynamic forces that overcome the surface tension forces that consolidate the liquid. The viscosity and density of the liquid also influence atomization behavior, but typically play a secondary role. The viscosity of the liquid affects both the degree of atomization and the spray pattern by influencing the amount of interfacial contact area between the liquid and the atomizing gas. Viscous liquids oppose changes in geometry more efficiently than do low-viscosity liquids, making the generation of a uniform atomized stream 16 more difficult for a given set of flow conditions. The density of the liquid influences how the liquid responds to momentum transfer from the atomizing gas. Light liquids accelerate more rapidly in the gas stream.

The dynamics of droplet break-up in high-velocity flows is quite complex. The Weber number (We) is a useful predictor of break-up tendency. The Weber number is the ratio of inertial forces to surface tension forces and is expressed by the following equation:

$$We = \frac{\rho V^2 D}{2\sigma}$$

where ρ is the density of the atomizing gas, V is the initial relative velocity between the atomizing gas flow and the droplet, D is the initial diameter of the droplet, and σ is the surface tension of the droplet. Break-up of liquid droplets will not occur unless the Weber number exceeds the critical value for the particular liquid involved.

Upon exiting the nozzle 54, the atomized stream 16 will typically comprise at least a two-phase (e.g., gas, liquid) flow. That is, the atomized stream 16 of coating material 48 will comprise at least a liquid fraction (e.g., the atomized liquid coating material 48) and a gas fraction (e.g., the atomizing gas). However, depending on the particular conditions, the atomized stream 16 exiting the nozzle 54 may comprise a multi-phase flow. That is, the atomized stream 16 of coating material 48 may comprise at least a liquid fraction (e.g., the atomized liquid coating material 48), a gas fraction (e.g., the atomizing gas), as well as a solid or frozen fraction (e.g., solidified or frozen coating material 48). In any event, once the atomized stream 16 leaves the nozzle 54, the atomized stream 16 will entrain amounts of the relatively cold ambient gas contained within the interior region 38 of process chamber 36. See FIG. 2. The relatively cold ambient gas contained within the interior region 38 of process chamber 36 provides a heat sink for the droplets contained in the atomized stream 16, producing droplets of the coating material 48 that are in at least a liquid state and at least a solid state. In many applications, the cooling provided by the ambient gas may result in an atomized stream 16 comprising droplets of coating material 48 in undercooled, liquid, solid, and semi-solid states.

Referring now to FIGS. 1-3, one method for producing the armor system 10 involves coating the core material 12 with a metal coating 14. Accordingly, the coating material 48 provided to the spray forming apparatus 34 comprises a metal. Metals capable of being sprayed by the spray forming apparatus 34 include pure molten metals, such as aluminum, titanium, zinc, or copper, as well as alloys thereof. Other metal alloys, including tin alloys, steels, bronzes, brasses, stainless steels, and tool steels may also be sprayed by the spray forming apparatus 34. When atomizing pure metals or metal alloys it is generally preferable to heat the metal alloys (e.g., by means of heater 50) to a temperature that is about 100° C. above the liquidus temperature of the metal or metal alloy. So heating the metal or metal alloy coating material 48 ensures that the coating material will not freeze or solidify within the nozzle 54.

As mentioned above, the coating material 48 to be deposited on the core material 12 to form the coating 14 may comprise any of a wide range of materials suitable for spraying by the spray forming apparatus 34. For example, in another embodiment wherein the coating 14 is to comprise a metal matrix composite, the spray forming apparatus 34 may be provided with a supply of molten metal (e.g., coating material 48). The spray forming apparatus 34 may also be provided with a suitable ceramic constituent, preferably in powder form. The ceramic constituent may be mixed with the supply of molten metal or separately provided to the nozzle 54 via a separate supply system (not shown), as described in the U.S. patents referenced above. In still another alternative, a metal matrix coating 14 may be formed by the use of appropriate metallic coating materials 48 and atomizing gases. For example, using nitrogen gas to atomize low carbon steel alloyed with aluminum results in the formation of fine aluminum nitride particles that act as grain boundary pinning sites to refine the steel micro-structure of the resulting coating 14.

Polymers can be deposited by the spray forming apparatus 34 by feeding a molten or plasticized polymer, by in-flight melting of polymer powders fed into the nozzle 54, or by dissolving the polymer in a suitable solvent and spraying the solution. Heating the atomizing gas to an appropriate temperature will facilitate in-flight evaporation of the solvent from the atomized droplets. Any remaining solvent may be evaporated at the coating 14. As with metals, polymers can be co-deposited with ceramics to form polymer matrix composites.

Depending on the type of material that is to be applied, it may be required or desired to pre-heat the core material 12 before depositing the coating 14. Generally speaking, preheating the core material 12 will allow the initial deposits of coating material 48 to remain in the liquid state on the surface of the core material 12 for some period of time before freezing or solidifying. In many applications, this will result in lower interfacial tension and improved adhesion of the coating material 14 to the core material 12. If so, it will be generally desirable to pre-heat the core material 12 to a temperature that is about equal to, or possibly greater than, the freezing or solidification temperature of the coating material 48 being deposited. Another benefit of preheating is that it minimizes thermal shock-related damage to the core material. In the embodiment shown and described herein, the core material 12 may be pre-heated by placing it within the heating system 64 provided within the process chamber 36. A suitable temperature sensing device, such as an infra-red sensor (not shown), may be used to sense when the core material 12 has reached the desired temperature.

According to one method of the embodiment, the coating 14 of the core material 12 is deposited in a two-step process. An initial layer 18 is deposited on the core material 12 by positioning the core material 12 in the atomized stream 16 of coating material 48. In the case where the coating material 48 comprises a metal (e.g., a pure metal or a metal alloy), the deposition of the initial layer 18 is performed at a point in the atomized stream 16 wherein the solid fraction (i.e., the portion of the coating material 48 that is in a solid or frozen state) is about less than the liquid metal fraction (i.e., the portion of the coating material 48 that is in the liquid state) on a weight basis. In the embodiment illustrated in FIG. 2, this step may be accomplished by positioning the core material 12 at a position in the atomized stream 16 that is closer to the outlet of the nozzle 54. That is, a smaller amount (on a weight basis) of the droplets contained in the atomized stream 16 are likely to be in the solid or frozen form at points closer to the nozzle 54, because the droplets will not yet have cooled to the extent required for them to freeze or solidify. As mentioned above, such in-flight cooling is due primarily to the entrainment within the atomized stream 16 of portions of the atmosphere contained within the interior region 38 of process chamber 36.

In an alternative arrangement, separate cooling apparatus (not shown) could be provided to selectively cool the atomized gas stream 16. Examples of such separate cooling apparatus are described in the referenced U.S. patents and will not be described in further detail herein. The separate cooling apparatus may be operated to provide a greater or lesser degree of cooling to the atomized stream 16, thereby allowing the liquid/solid ratio of the atomized stream 16 to be varied at a given distance from the nozzle 54. Thus, such separate cooling apparatus may dispense with the need to move the core material 12 relative to the atomized stream 16 in order to expose the core material 12 to the point in the atomized stream 16 having the desired liquid/solid ratio.

In one embodiment, the composition (i.e., the weight ratio of solid fraction to liquid fraction) of the coating material 48 contained in the atomized stream 16 is determined computationally from a model of the spray forming apparatus 34. That is, the relative amounts of the solid and liquid fractions of the coating material 48 contained in the atomized stream 16 are not actually measured, but rather are computationally determined based on a mathematical model of the spray forming apparatus. Consequently, the actual ratios of the solid and liquid fractions may differ somewhat from those determined computationally. However, such computational modeling is highly refined and generally provides highly accurate and definitive results.

Regardless of the particular manner in which the core material 12 is exposed to the atomized stream 16 at a point wherein the solid fraction is less than the liquid fraction of the coating material 48, so positioning the core material 12 improves the surface wetting and adhesion of the initial layer 18. Because the purpose of the initial layer 18 is to provide improved surface wetting and adhesion of the coating 14, the thickness of the initial layer 18 is not particularly critical, so long as the initial layer 18 has sufficient thickness to coat substantially the entirety of the exposed surface of the core material 12. Consequently, the present invention should not be regarded as limited to initial layers having any particular thicknesses. However, by way of example, in one embodiment wherein the coating material 48 comprises metal, the initial layer may have a thickness in a range of about 0.5 mm to about 3 mm (1 mm preferred).

After the initial layer 18 is deposited, the outer layer 20 is deposited on the initial layer 18 by positioning the core material 12 in the atomized stream 16 at a point wherein the solid fraction of the coating material 48 is greater than the liquid fraction of the coating material 48. In one embodiment, this may be accomplished by moving the core material 12 (and the deposited initial layer 18) to a position somewhat farther away from the nozzle 54. In another embodiment involving a separate cooling system, the cooling system could be operated so as to provide additional cooling, thus increase the proportionate amount of solid fraction to liquid fraction of coating material 48 contained in the atomized spray stream 16.

Regardless of the particular manner in which the core material 12 is exposed to the atomized stream 16 at a point wherein the solid fraction is greater than the liquid fraction of the coating material 48, so positioning the core material 12 results in the rapid deposition of the outer layer 20 and tends to result in a more favorable coating micro-structure. That is, the micro-structure of spray-formed metals and metal alloys and the non-equilibrium solidification associated therewith tends to limit segregation and results in a higher degree of equi-axial grain formation. In addition, constituent-phase particle sizes tend to be somewhat finer than those found in wrought commercial material and significantly finer than cast material.

The outer layer 20 should be deposited on substantially all of the surfaces of the core material 12, so as to result in a coating 14 that encapsulates substantially the entirety of the core material 12. The deposition process may be conducted until the coating 14 has reached the desired thickness. As mentioned above, the coating 14 may be deposited in any of a range of thicknesses depending on the particular type of coating material 48, the type of core material 12, as well as on the desired performance of the armor system 10. Accordingly, the present invention should not be regarded as limited to coatings 14 having any particular thicknesses. However, notwithstanding the fact that the coating 14 may comprise any of a range of thicknesses, the performance of the armor system 10 can be enhanced when the thickness of the coating 14 bears some relation to the thickness of the core material 12.

For example, in the embodiment illustrated in FIG. 1, wherein the core material 12 comprises a generally plate-like or tile-like configuration having a front surface 24, a back surface 26 and one or more side surfaces 28, the performance of the armor system 10 is generally enhanced if the thickness 30 of the coating 14 provided on the front surface 24 of the core material 12 is generally equal to or greater than about 0.5 times the thickness 22 of the core material 12. Similarly, the thickness 32 of the coating 14 provided on the back surface 26 of core material 12 may be generally equal to or greater than about 1.5 times the thickness 22 of the core material 12. The thickness 35 of the coating 14 provided on the one or more side surfaces 28 of the core material 12 may be at least generally equal to or greater than the thickness 22 of the core material 12.

In another embodiment, the coating 14 of the core material 12 is deposited in a single-step process. In the single-step coating process, the deposition of the coating 14 is performed at a point in the atomized stream 16 wherein the solid fraction (i.e., the portion of the coating material 48 that is in a solid or frozen state) is generally greater than the liquid metal fraction (i.e., the portion of the coating material 48 that is in the liquid state) on a weight basis. Generally speaking, solid fraction amounts of at least about 50% (by weight) and more preferably generally greater than about 70% (by weight) solid fraction amounts will result in favorable coating properties. That is, single-step coating processes wherein the atomized stream 16 comprises a comparatively high solids fraction (e.g., greater than about 50% and more preferably greater than about 70% by weight) reduces the compressive stresses likely to be produced in the core material 12 after cooling. However, sufficient liquid fraction component (e.g., 30% to 50% by weight) should be provided to fill interstitial voids within the coating to provide a higher density, less porous coating 14. The coating 14 should be provided over substantially the entirety of the core material 12, that is, so that the core material 12 is substantially encapsulated by the coating 14. The coating 14 may be deposited to the thicknesses described herein.

After the coating 14 has been deposited on the core material 12, the coating may be compressed to consolidate and increase the density of the coating 14. In one embodiment, such compression or consolidation may be accomplished by positioning the coated armor system 10 in the press system 66. The press system 66 compresses the coating 14, thereby increasing its density. In one embodiment wherein the coating 14 comprises a metal, it is generally preferable to press the coating 14 as quickly as possible (e.g., within 5-10 seconds) following deposition of the outer layer 20. This allows the coating 14 to be compressed while the coating 14 is still comparatively soft. Besides uni-axial pressing, the coating 14 may also be compressed by other processes known in the art, such as, for example by hot isostatic pressing and by cold isostatic pressing. However, because such processes are well-known in the art and could be easily provided by persons having ordinary skill in the art after having become familiar with the teachings provided herein, the particular pressing processes and apparatus for performing those processes will not be described in further detail herein.

The pressure provided by the press system 66 may comprise any of a wide range of pressures suitable for compressing the coating material utilized in the particular application. Consequently, the present invention should not be regarded as limited to any particular pressures. However, by way of example, in one embodiment wherein the coating material 48 comprises a metal, the press system 66 provides an axial pressure in a range of about 1 MPa to about 100 MPa (30 MPa preferred).

After pressing or consolidation, the armor system 10 may be heat treated (e.g., annealed or hardened), as may be desired to provide the armor system 10 with the desired performance. However, because heat treating processes, such as annealing and hardening, are known in the art and could be readily provided by persons having ordinary skill in the art after having become familiar with the teachings provided herein, and after considering the desired performance of the armor system 10, the particular heat treating processes that may be performed on the armor system 10 will not be described in further detail herein.

Another method for producing the armor system 10 involves encapsulating substantially the entirety of the core material 12 with the coating 14 by positioning the core material 12 in the stream 16 of atomized coating material 48. The coating 14 may be applied in a single-step process, wherein substantially the entire coating 14 is applied at once. Alternatively, the coating 14 may be applied in the two-step process described above involving the deposition of an initial layer (e.g., layer 18) followed by the deposition of an outer layer (e.g., outer layer 20) in the manner already described.

EXAMPLE

An armor system 10 according to the present invention was manufactured in accordance with the teachings provided herein. The core material 12 was CoorsTek type AD90 alumina tile. The tile comprised a square configuration having side lengths of about 100 mm and a thickness of about 3.2 mm. The coating material comprised SAE 5083 aluminum alloy. The process chamber 36 was filled with a nitrogen gas atmosphere. The nitrogen gas was introduced into the process chamber 36 at about room temperature. The pressure within the chamber process 36 was maintained at a pressure of about 100 kPa.

Molten 5083 aluminum alloy was provided to the coating material feed assembly 44 and maintained at a temperature of about 750° C., which is about 100° C. above the liquidus temperature for the alloy. The atomizing gas comprised nitrogen and was provided to the inlet (i.e., converging section 56) of nozzle 54 at a total temperature of about 700° C. and a total pressure of about 150 kPa. The nitrogen atomized the molten aluminum alloy, forming an atomized stream 16 of molten 5083 aluminum alloy. The alumina core material 12 was pre-heated to a temperature of about 500° C. before deposition by placing the alumina core material 12 in the core heating system 64.

An initial metal layer 18 was deposited on all surfaces of the alumina tile core material 12 by positioning the alumina tile in the atomized stream 16 at a distance approximately 20 cm from the nozzle 54. At this distance, theoretical calculations indicated that the liquid metal fraction of the aluminum alloy contained in the atomized stream 16 should be about equal to the solid metal fraction of the aluminum alloy contained in the atomized stream 16. An initial metal layer was deposited to a thickness of about 1 mm. An outer layer 20 was then deposited on the initial layer 18 by moving the alumina tile away from the nozzle 54 until it was located a distance of about 30-38 cm from the nozzle 54. At this distance, theoretical calculations indicated that the solid metal fraction of the atomized stream 16 comprised about 70% on a weight basis. The deposition process was continued until the coating 14 was deposited to a thickness sufficient to achieve the following thicknesses after machining (for coating uniformity):

| | |
|---|---|
| Front: | 3.2 mm |
| Side: | 6.4 mm |
| Back: | 6.4 mm |

The line-of-sight (LOS) areal density at the center of the armor system was estimated to be about 39 kg/m$^2$ (8 lb/sq ft). The overall dimensions of the armor system 10, after machining for uniformity were about 11.4 cm×11.4 cm×1.3 cm. Thereafter, the armor system 10 was annealed at a temperature of about 415° C. for a time of about 4 hours.

The properties of the 5083 aluminum alloy formed by the spray deposition process described herein have been determined as follows:

| Condition | Ultimate Tensile Strength (MPa) | Yield Strength (MPa) | Elongation at Failure (%) |
|---|---|---|---|
| Commercial wrought-Annealed (0 temper) | 289 | 145 | 22 |
| As spray formed | 276 | 221 | 8 |
| Spray formed-annealed (530° C.□C, 10 min.) | 262 | 131 | 20 |
| Spray formed-annealed (530° C.□C, 30 min.) | 296 | 131 | 20 |
| Spray formed-annealed (530° C.□C, 1 hr.) | 303 | 124 | 31 |
| Spray formed-annealed (530° C.□C, 2 hr.) | 296 | 131 | 34 |
| Spray formed-annealed (530° C.□C, 4 hr.) | 303 | 131 | 34 |
| Spray formed-annealed (530° C.□C, 8 hr.) | 303 | 138 | 37 |

The armor system 10 was live-fire tested in accordance with MIL-STD-662 to verify ballistic performance. The armor system 10 was impacted at a stand-off of about 6.25 m and at zero degrees obliquity (i.e., perpendicular to the front surface of the armor system). The test round was a 7.62×39 mm 1943 PS ball with a mild steel core. The powder was reloaded to ensure a muzzle velocity of 725±7.6 m/s. A 6061 aluminum witness block was placed behind the armor system 10 to capture any behind-armor debris. The witness block was not mechanically fastened to the armor system 10.

Figure 4:
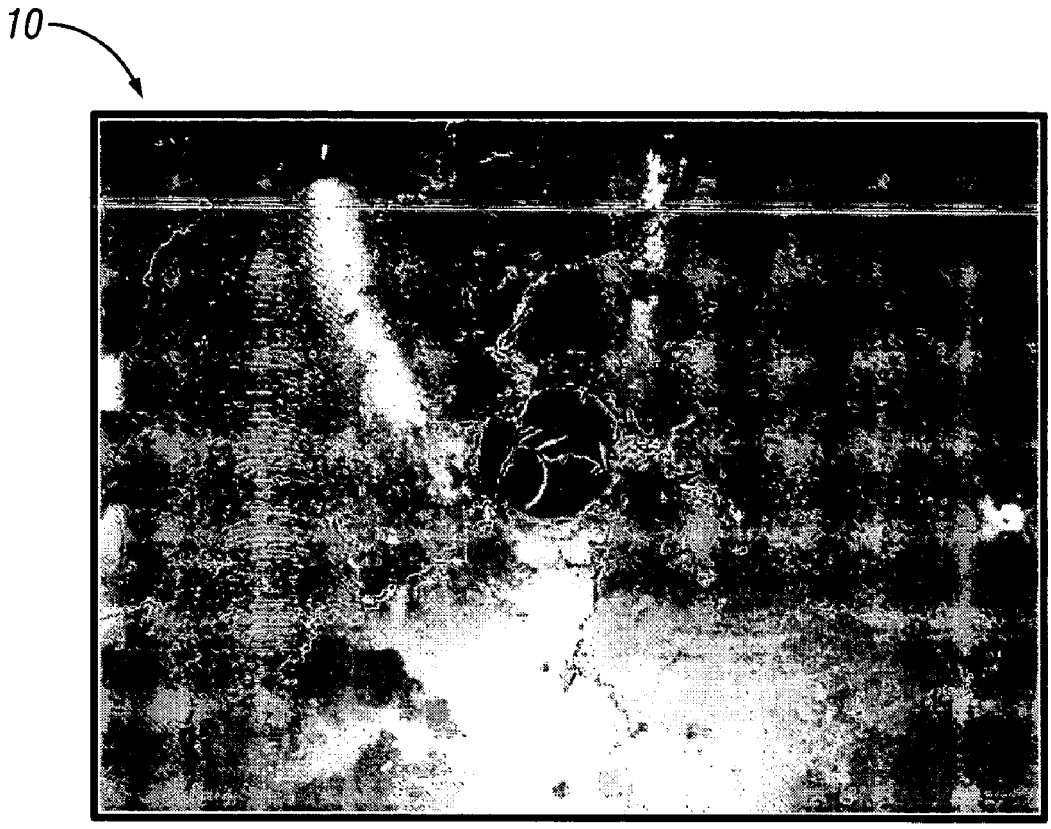
FIG. 4 is a photograph of the frontal impact face of the armor system after absorbing a ballistic impact.
Figure 5:
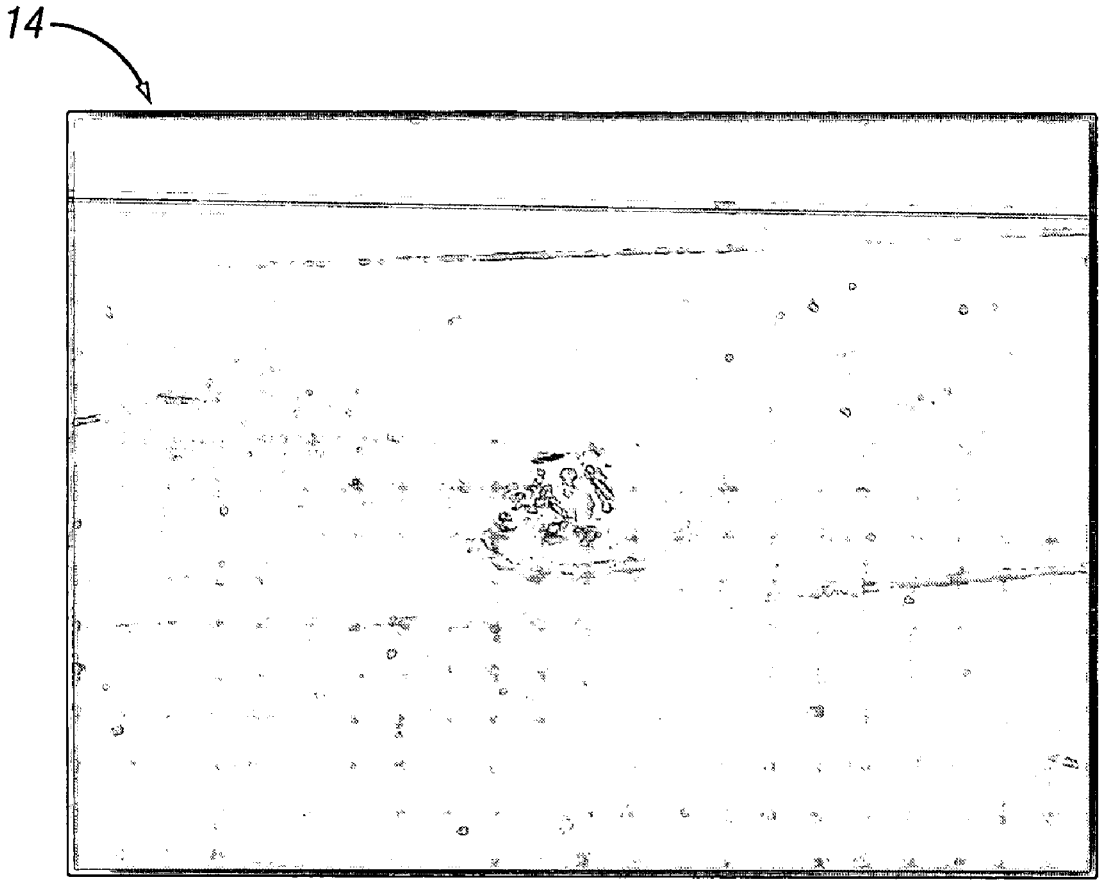
FIG. 5 is a photograph of the back face of the armor system illustrated in FIG. 4.
Figure 6:
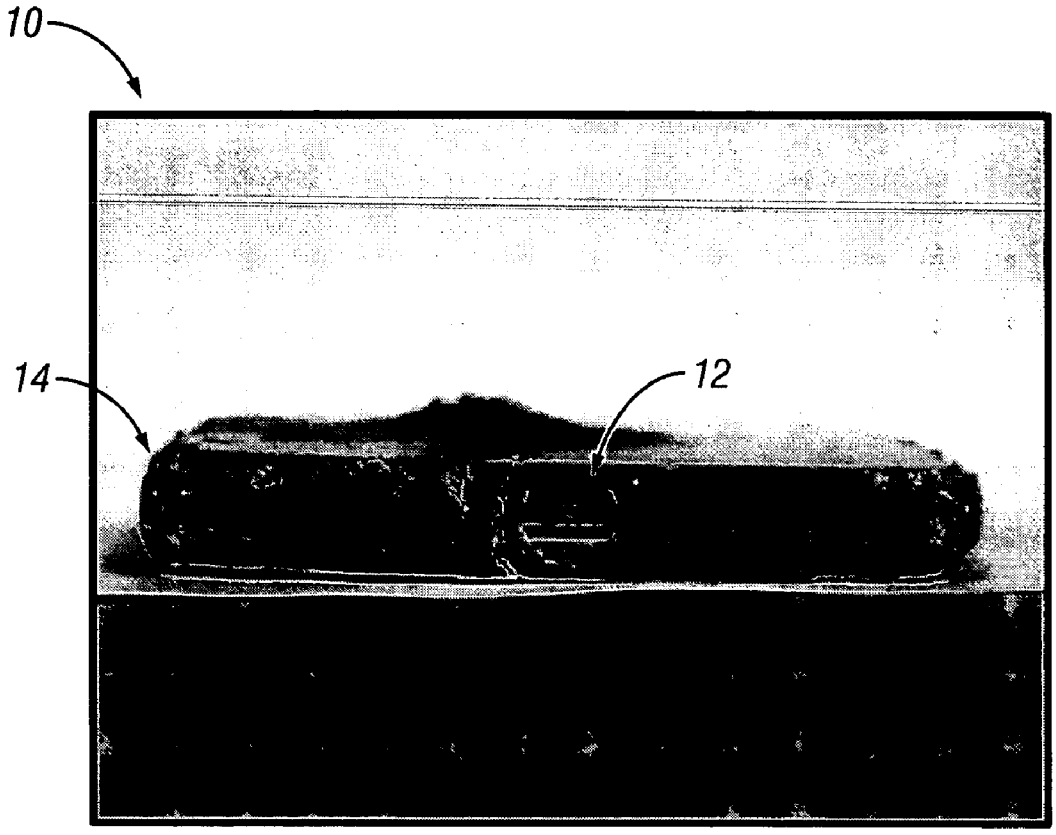
FIG. 6 is a photograph of the armor system illustrated in FIG. 4 with a portion of the coating removed to show the core material.

The results of the live-fire test on the armor system are presented in FIGS. 4-6. In FIG. 4, the "boat-tail" of the test round is clearly visible from the frontal perforation. FIG. 5 shows a slight breakage at the back surface. However, there was no evidence of any material release from the breakage. Moreover, no evidence of impacts or indentations could be observed on the face of the witness block, indicating the entire test round was stopped and captured by the armor system 10.

FIGS. 4-6 also show that the crack formation on the front (i.e., impact surface) and damage to the coating 14 were minimal. Additionally, there is evidence that the ceramic core material 12 inside the encapsulating coating 14 was mostly intact, as best seen in FIG. 6. This evidence suggests that the armor system 10 possesses potential multiple hits capability.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A method for producing an armor system, comprising:

forming a core material comprising a front surface, a back surface, at least one side surface, and a thickness between the front surface and the back surface;

providing a stream of atomized coating material having a material composition and comprising a liquid fraction and a solid fraction;

depositing an initial layer of the coating material having the material composition on at least the front surface and the back surface of the core material by positioning the core material in the stream of atomized coating material wherein the solid fraction of the coating material in the stream of atomized coating material is less than the liquid fraction of the coating material in the stream of atomized coating material on a weight basis;

depositing another layer of the same coating material having the material composition on the initial layer of the coating material by positioning the core material in the stream of atomized coating material wherein the solid fraction of the coating material in the stream of atomized coating material is greater than the liquid fraction of the coating material in the stream of atomized coating material on a weight basis;

forming the initial layer and the another layer of the coating material to have a first combined thickness on the front surface of the core material; and forming the initial layer and the another layer of the coating material to have a second combined thickness on the back surface of the core material at least about three times the first combined thickness of the initial layer and the another layer of the coating material on the front surface of the core material.

2. The method of claim 1, wherein providing the stream of atomized coating material comprises providing a stream of atomized metal comprising a liquid metal fraction and a solid metal fraction.

3. The method of claim 2, wherein depositing the initial layer of the coating material comprises positioning the core material at a first location in the stream of atomized metal wherein the solid fraction of the metal in the stream of atomized metal is less than the liquid fraction of the metal in the stream of atomized metal on a weight basis; and wherein depositing another layer comprises positioning the core material at a second location in the stream of atomized metal wherein the solid fraction of the metal in the stream of atomized metal is greater than the liquid fraction of the metal in the stream of atomized metal on a weight basis.

4. The method of claim 3, wherein the solid fraction of the metal in the stream of atomized metal at the second location is in a range of about 50% to about 90% on a weight basis.

5. The method of claim 4, wherein the solid fraction of the metal in the stream of atomized metal at the second location is about 70% on a weight basis.

6. The method of claim 2, wherein depositing the initial layer of the coating material comprises depositing an initial metal layer having a thickness in a range of about 0.5 to about 3 mm.

7. The method of claim 2, wherein depositing another layer of the coating material comprises depositing another metal layer having a thickness in a range of about 1 to about 125 mm.

8. The method of claim 2, further comprising providing a ceramic material in the stream of atomized metal and forming a stream of atomized metal with entrained ceramic material.

9. The method of claim 1, further comprising heat treating the initial layer of the coating material and the another layer of the coating material following depositing the another layer of the coating material.

10. The method of claim 9, wherein heat treating is selected from the group consisting of annealing and hardening.

11. The method of claim 1, further comprising compressing the initial layer of the coating material and the another layer of the coating material after depositing the another layer of the coating material to increase a density of at least one of the initial layer of the coating material and the another layer of the coating material.

12. The method of claim 11, further comprising heat treating the initial layer of the coating material and another layer of the coating material following compressing.

13. The method of claim 12, wherein heat treating is selected from the group consisting of annealing and hardening.

14. The method of claim 1, further comprising heating the core material before depositing the initial layer of the coating material.

15. The method of claim 14, wherein heating the core material comprises heating the core material to a temperature equal to or less than a liquidus temperature of the coating material.

16. The method of claim 1, further comprising depositing the initial layer of the coating material and the another layer of the coating material in an at least substantially oxygen-free atmosphere.

17. The method of claim 16, further comprising depositing the initial layer of the coating material and the another layer of the coating material in nitrogen.

18. The method of claim 1, further comprising maintaining the at least substantially oxygen-free atmosphere at a pressure of about 100 kPa.

19. The method of claim 2, wherein depositing the initial layer of the coating material comprises cooling the stream of atomized metal and forming a stream of atomized metal wherein the solid metalfraction in the stream of atomized metal is less than the liquid metal fraction in the stream of atomized metal on a weight basis; and wherein depositing another layer of the coating material comprises additionally cooling the stream of atomized metal and forming a stream of atomized metal wherein the solid metal in the stream of atomized metal is greater than the liquid metalfraction in the stream of atomized metal on a weight basis.

20. The method of claim 2, further comprising selecting the core material to comprise a material selected from the group consisting of aluminum oxide, silicon carbide, and titanium diboride.

21. A method for producing an armor system, comprising:

forming a core material comprising a front surface, a back surface, at least one side surface, and a thickness between the front surface and the back surface;

depositing an initial layer of a coating material having a material composition over at least the front surface and the back surface of the core material by positioning the core material in an atomized stream of the coating material wherein a solid fraction of the coating material in the atomized stream is less than a liquid fraction of the coating material in the atomized stream on a weight basis; and depositing another layer of the coating material having the material composition on the initial layer of the coating material by positioning the core material in the atomized stream of the coating material wherein the solid fraction of the coating material in the atomized stream is greater than the liquid fraction of the coating material in the atomized stream on a weight basis;

wherein depositing the another layer of the coating material comprises depositing the another layer of the coating material over the front surface of the core material so that a combined thickness of the initial layer of the coating material and the another layer of the coating material on the front surface of the core material is greater than about 0.5 times the thickness of the core material, and depositing the another layer of the coating material over the back surface of the core material so that a combined thickness of the initial layer of the coating material and the another layer of the coating material on the back surface of the core material is greater than about 1.5 times the thickness of the core material, the combined thickness of the initial layer of the coating material and the another layer of the coating material on the back surface of the core material being at least about three times the combined thickness of the initial layer of the coating material and the another layer of the coating material on the front surface of the core material.

22. An armor system made in accordance with a method, the method comprising:

providing a stream of atomized coating material having a material composition comprising a liquid fraction and a solid fraction;

depositing an initial layer of the coating material having the material composition on a surface of a core material by positioning the core material in the stream of atomized coating material wherein the solid fraction of the coating material in the stream of atomized coating material is less than the liquid fraction of the coating material in the stream of atomized coating material on a weight basis;

depositing another layer of the same coating material on the initial layer of the coating material by positioning the core material in the stream of atomized coating material wherein the solid fraction of the coating material in the stream of atomized coating material is greater than the liquid fraction of the coating material in the stream of atomized coating material on a weight basis;

forming the initial layer and the another layer of the coating material to have a first combined thickness on the front surface of the core material; and forming the initial layer and the another layer of the coating material to have a second combined thickness on the back surface of the core material at least about three times the first combined thickness of the initial layer and the another layer of the coating material on the front surface of the core material.

23. A method for producing an armor system, comprising:

providing a stream of atomized coating material comprising a liquid fraction and a solid fraction;

depositing an initial coating layer on a surface of a core material by positioning the core material at a first location in the stream at which the solid fraction of coating material in the stream is less than the liquid fraction of coating material in the stream on a weight basis;

depositing another coating layer on the initial coating layer by positioning the core material at a second, different location in the stream at which the solid fraction of coating material in the stream is greater than the liquid fraction of coating material in the stream on a weight basis;

compressing the initial coating layer and the another coating layer after depositing the another coating layer to increase a density of at least one of the initial coating layer and the another coating layer;

forming the initial coating layer and the another coating layer to have a first combined thickness on the front surface of the core material; and forming the initial coating layer and the another coating layer to have a second combined thickness on the back surface of the core material at least about three times the first combined thickness of the initial coating layer and the another coating layer on the front surface of the core material.

24. The method of claim 11, wherein compressing is selected from the group consisting of compressing by uniaxial pressing, compressing by hot isostatic pressing, and compressing by cold isostatic pressing.

25. The method of claim 1, further comprising depositing the another layer of the coating material over the front surface of the core material so that a combined thickness of the initial layer of the coating material and the another layer of the coating material on the front surface of the core material is greater than about 0.5 times the thickness of the core material, and depositing the another layer of the coating material over the back surface of the core material so that a combined thickness of the initial layer of the coating material and the another layer of the core material on the back surface of the core material is greater than about 1.5 times the thickness of the core material.

26. The method of claim 25, further comprising compressing the initial layer of the coating material and the another layer of the coating material after depositing the another layer of the coating material to increase a density of at least one of the initial layer of the coating material and the another layer of the coating material.

27. A method for producing an armor system, comprising:

providing a stream of atomized coating material having a material composition and comprising a liquid fraction and a solid fraction;

depositing an initial layer of the coating material having the material composition on a surface of a core material by positioning the core material in the stream of atomized coating material wherein the solid fraction of the coating material in the stream of atomized coating material is less than the liquid fraction of the coating material in the stream of atomized coating material on a weight basis;

depositing another layer of the same coating material having the material composition on the initial layer of the coating material by positioning the core material in the stream of atomized coating material wherein the solid fraction of the coating material in the stream of atomized coating material is greater than the liquid fraction of the coating material in the stream of atomized coating material on a weight basis; and compressing the initial layer of the coating material and the another layer of the coating material after depositing the another layer of the coating material to increase a density of at least one of the initial layer of the coating material and the another layer of the coating material.

* * * * *

UNITED STATES PATENT AND TRADEMARK OFFICE

CERTIFICATE OF CORRECTION

PATENT NO. : 7,838,079 B2
APPLICATION NO. : 10/992521
DATED : November 23, 2010
INVENTOR(S) : Henry S. Chu, Thomas M. Lillo and Kevin M. McHugh It is certified that error appears in the above-identified patent and that said Letters Patent is hereby corrected as shown below:

In the specification:

| | | |
|---|---|---|
| COLUMN 6, | LINE 65, | change "any a" to --any of a-- |
| COLUMN 14, | LINE 13, | change "(530° C.□C, 10 min.)" to --(530°C, 10 minutes)-- |
| COLUMN 14, | LINE 15, | change "(530° C.□C, 30 min.)" to --(530°C, 30 minutes)-- |
| COLUMN 14, | LINE 17, | change "(530° C.□C, 1 hr.)" to --(530°C, 1 hour)-- |
| COLUMN 14, | LINE 19, | change "(530° C.□C, 2 hr.)" to --(530°C, 2 hours)-- |
| COLUMN 14, | LINE 21, | change "(530° C.□C, 4 hr.)" to --(530°C, 4 hours)-- |
| COLUMN 14, | LINE 23, | change "(530° C.□C, 8 hr.)" to --(530°C, 8 hours)-- |

Signed and Sealed this
Tenth Day of September, 2013

Teresa Stanek Rea
*Acting Director of the United States Patent and Trademark Office*